US007143693B2

(12) United States Patent
Ruschkowski

(10) Patent No.: US 7,143,693 B2
(45) Date of Patent: Dec. 5, 2006

(54) WASHING AND CLEANING DEVICE FOR CYLINDERS, ESPECIALLY PRINTING FORM CYLINDERS AND OFFSET BLANKET CYLINDERS IN A PRINTING MACHINE

(75) Inventor: Johannes Ruschkowski, Augsburg (DE)

(73) Assignee: Man Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/510,489

(22) PCT Filed: Apr. 7, 2003

(86) PCT No.: PCT/EP03/03568

§ 371 (c)(1),
(2), (4) Date: Oct. 7, 2004

(87) PCT Pub. No.: WO03/084757

PCT Pub. Date: Oct. 16, 2003

(65) Prior Publication Data

US 2005/0160933 A1 Jul. 28, 2005

(30) Foreign Application Priority Data

Apr. 9, 2002 (DE) ..... 102 15 612

(51) Int. Cl.
*B41F 35/00* (2006.01)

(52) U.S. Cl. ..... 101/425; 101/424

(58) Field of Classification Search ..... 101/423–425
See application file for complete search history.

(56) References Cited

U.S. PATENT DOCUMENTS 4,986,182 A * 1/1991 Sawaguchi et al. ..... 101/483
5,105,740 A 4/1992 Loos et al. ..... 101/425
5,275,104 A * 1/1994 Corrado et al. ..... 101/425
5,390,602 A * 2/1995 Gorl ..... 101/425
5,842,418 A * 12/1998 Corrado et al. ..... 101/425
5,894,800 A 4/1999 Bär et al. ..... 101/425
6,694,879 B1 2/2004 Schuster et al. ..... 101/425

FOREIGN PATENT DOCUMENTS

DE 39 09 119 A1 9/1990
DE 195 43 518 A1 5/1997
DE 100 08 214 A1 8/2001

* cited by examiner

*Primary Examiner*—Anthony H. Nguyen
(74) *Attorney, Agent, or Firm*—Cohen, Pontani, Lieberman & Pavane

(57) ABSTRACT

An erasing and cleaning apparatus for cylindrical surfaces including a cleaning cloth transporting device which can be packaged with a cleaning cloth in a cassette. The cassette is exchangeably inserted between side walls of a positioning unit, the positioning unit being connectable with a drive for driving transporter device. A lateral guide is arranged in a printing press and includes a carriage and a device for moving the positioning unit between a first position, in the which the transporter is moved onto the cylindrical surface to be cleaned, and an out-of-contact position, at which said cassette is laterally removable from the positioning unit. The erasing and cleaning apparatus further includes at least one coupling module for selectively coupling and decoupling a removable one of the sidewalls of the positioning unit to and from the cassette.

4 Claims, 5 Drawing Sheets

WASHING AND CLEANING DEVICE FOR CYLINDERS, ESPECIALLY PRINTING FORM CYLINDERS AND OFFSET BLANKET CYLINDERS IN A PRINTING MACHINE

PRIORITY CLAIM

This is a U.S. national stage of application No. PCT/EP03/03568, filed on 7 Apr. 2003. Priority is claimed on that application and on the following application(s): Country: Germany, Application No.: 102 15 612.3, Filed: 9 Apr. 2004.

BACKGROUND OF THE INVENTION

1. Field of the Invention

The invention relates to an erasing and cleaning apparatus, also called an erasing station, for cleaning cylindrical surfaces, in particular of printing form and blanket cylinders within printing presses with the aid of a cleaning cloth which is prepackaged in a cassette and can be moved by cleaning cloth transport means.

2. Description of the Prior Art

An erasing and cleaning apparatus of this type is known from U.S. Pat. No. 6,649,879.

The cleaning apparatus essentially comprises a clean cloth roll and a dirty cloth roll for accommodating a cleaning cloth which is impregnated with washing fluid and is pulled off the clean cloth roll onto the dirty cloth roll. Here, the cleaning cloth is always held under tensile stress by pressure means in the form of a wash roll. Furthermore, the cleaning apparatus is configured as a slide-in system and, in the installed state, is assigned to the cylindrical body which is configured, for example, as a blanket cylinder. The prepackaged cleaning cloth is moved into and out of contact with the blanket cylinder or an arbitrary cylinder of a printing unit by a positioning unit. A washing fluid supply system fixed to the machine is assigned to the cleaning apparatus. The clean cloth roll, the wash roll and the dirty cloth roll are mounted rotatably in two side parts arranged in parallel with one another. The wash roll has a surface which has an elastic coating and serves as a pressure element in order to press the cleaning cloth against the cylindrical body and simultaneously guide the cleaning cloth. The side parts of the slide-in system (that is to say, of the positioning unit) are connected to one another via a crossmember. The cleaning cloth is guided in as large a wrapping angle as possible from the clean cloth roll over the wash roll in the pulling direction of the dirty cloth roll. The cleaning cloth is wetted with a washing fluid. Drive is imparted to the dirty cloth roll via a shaft and gear wheel. The dirty cloth roll is operated intermittently and pulls the cleaning cloth from the clean cloth roll over the wash roll, which brings the cleaning cloth into contact with the cylindrical body to be cleaned, in the pulling direction and accommodates the cleaning cloth on a shaft.

It is possible to use the cassette universally in the printing press for every cylinder desired as a result of the fact that all the cleaning cloth transport means including the cleaning cloth are packaged in an independent cassette and a modular positioning unit can be arranged fixedly in the printing press, it being necessary to arrange only one positioning unit. It is not necessary to exchange the cleaning apparatus completely but only to remove the independent cassette from the positioning unit.

Hitherto, it has been somewhat cumbersome to change the cleaning cloth or exchange the cleaning cassette, to the extent that it cannot be performed when the printing press is running or with a paper web tensioned in the printing unit.

SUMMARY OF THE INVENTION

It is an object of the present invention to make it easier to change the cleaning cloth and to shorten the time required for said change for an erasing and cleaning apparatus of the generic type, in particular such that it can also be performed while a paper web is tensioned in the printing unit and the printing press is running.

In order to achieve this object, a configuration of an erasing and cleaning apparatus for cylinders according to the precharacterizing clause of patent claim 1 having the features of the characterizing part of patent claim 1 is proposed according to the invention.

BRIEF DESCRIPTION OF THE DRAWINGS

In the following text, the invention is to be explained in greater detail using the drawing. In the associated figures, in diagrammatic form.

In the drawings wherein like reference characters denote similar elements throughout the several views.

DETAILED DESCRIPTION OF THE PREFERRED EMBODIMENTS

Figure 1:
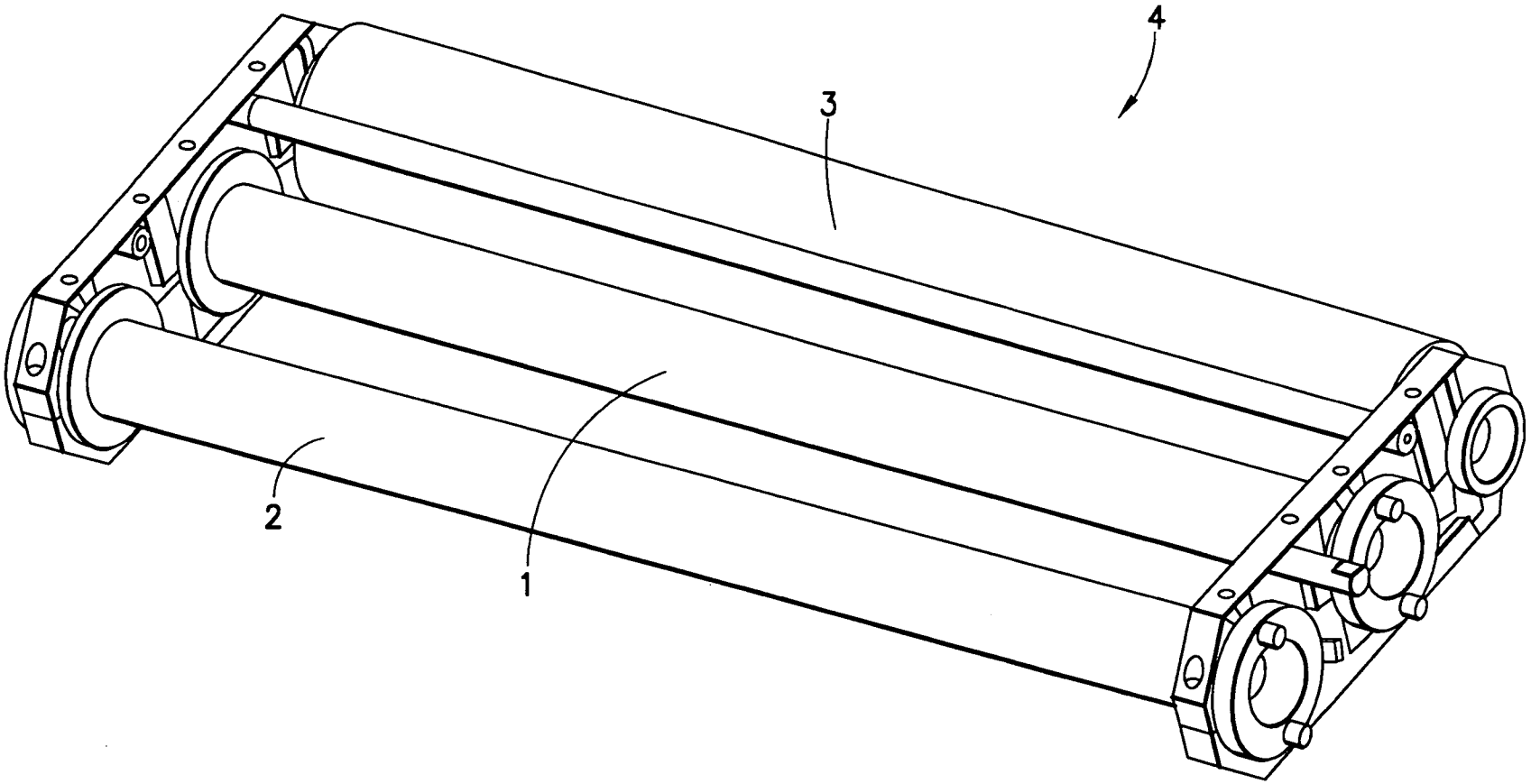
FIG. 1 is a perspective view of a cleaning cloth transport which is housed in an exchangeable cassette.

According to FIG. 1, the cleaning cloth transport means for one exemplary embodiment of the erasing and cleaning apparatus according to the invention for cylindrical surfaces comprise a clean cloth roll 1, a pressure means in the form of a wash roll 3, and a dirty cloth roll 2 which are all packaged in an independent cassette 4. A continuous cleaning cloth (not shown here) can be unwound from the clean cloth roll 1, as shown in U.S. Pat. No. 6,694,879, and fed to the dirty cloth roll 2 via the wash roll 3.

The cassette 4 is designed as an exchangeable unit, that is to say the cleaning cloth is changed by replacing an independent unit of this type in the form of the cassette 4.

Figure 2:
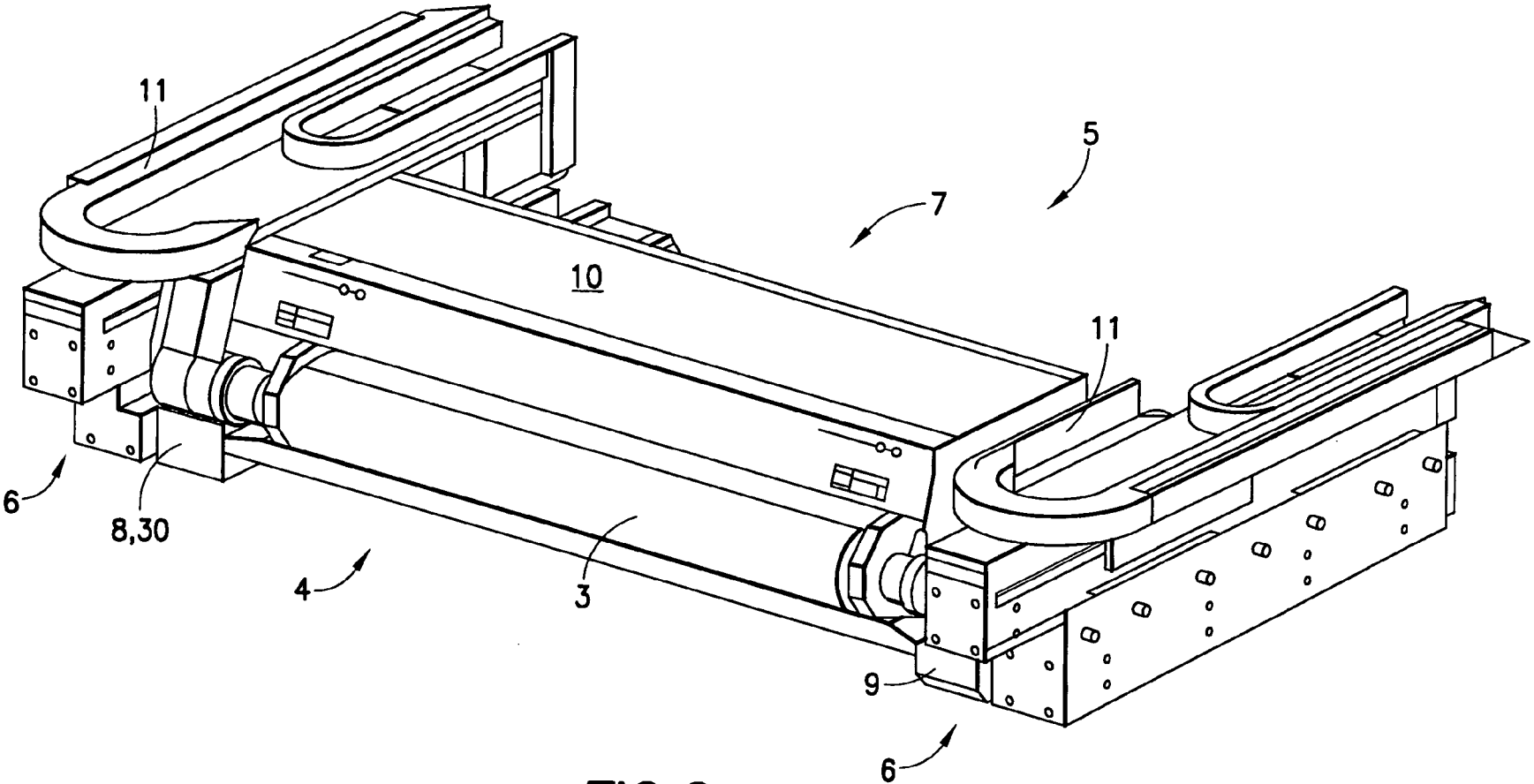
FIG. 2 is a perspective view of the cassette of FIG. 1 pushed into a positioning unit which is fixed in the printing press.

FIG. 2 shows the cassette 4 described above in the state in which it is pushed into a positioning unit 5 of the erasing and cleaning apparatus according to the invention. As is known, the positioning unit 5 is arranged fixedly in the printing press and can interact with the inserted cassette 4, that is to say the cassette 4 can be connected with a form-fitting and force-transmitting connection to the positioning unit 5 in the state in which it is pushed into the latter, for instance in the manner of a video cassette in its associated drive, it being possible to attach a drive for the cleaning cloth transport means 1 to pivotably to the positioning unit 5 in a known manner, with the result that the positioning unit 5 and the drive (not shown here) form a modular construction.

At least one drive motor serves to drive the cleaning cloth and is controlled by a computer program which can make it possible to advance the cleaning cloth section by section and possibly to transport it backward partially after every cleaning operation, and finally to rewind the used cleaning cloth from the dirty cloth roll 2 to the clean cloth roll 1.

The positioning unit 5 has carriages 6 which are arranged on side parts of the printing press, can be moved by means of pneumatic or hydraulic means transversely onto the cylindrical surface to be cleaned, can be moved away again from the latter, and on which a superstructure 7 is arranged to accommodate the cassette 4 in the form of two side walls 8, 9 which are connected via a crossmember 10. The cassette 4 is secured on the superstructure 7 or on the crossmember 10 in a working position by a bolt (not shown here). Furthermore, in the working position of the cassette 4, the supply of cloth on the clean cloth roll 1 can be monitored by sensing means (see, for example, U.S. Pat. No. 5,894,800) which are moved into a functional position when the cassette 4 is slid in.

The cleaning cloth is brought into contact with the cylinder circumferential surface across its entire width by the pressure body 3, the exertion of force for producing a frictional force being generated by an activatable drive, as has already been mentioned.

A nozzle head for supplying the cleaning medium is integrated in the crossmember 10 in a known manner, said nozzle head being connected to a movable cable guide 11 (for the supply of cleaning medium) and being displaceable in a known manner along the crossmember 10 parallel to the cylindrical surface.

Figure 3:
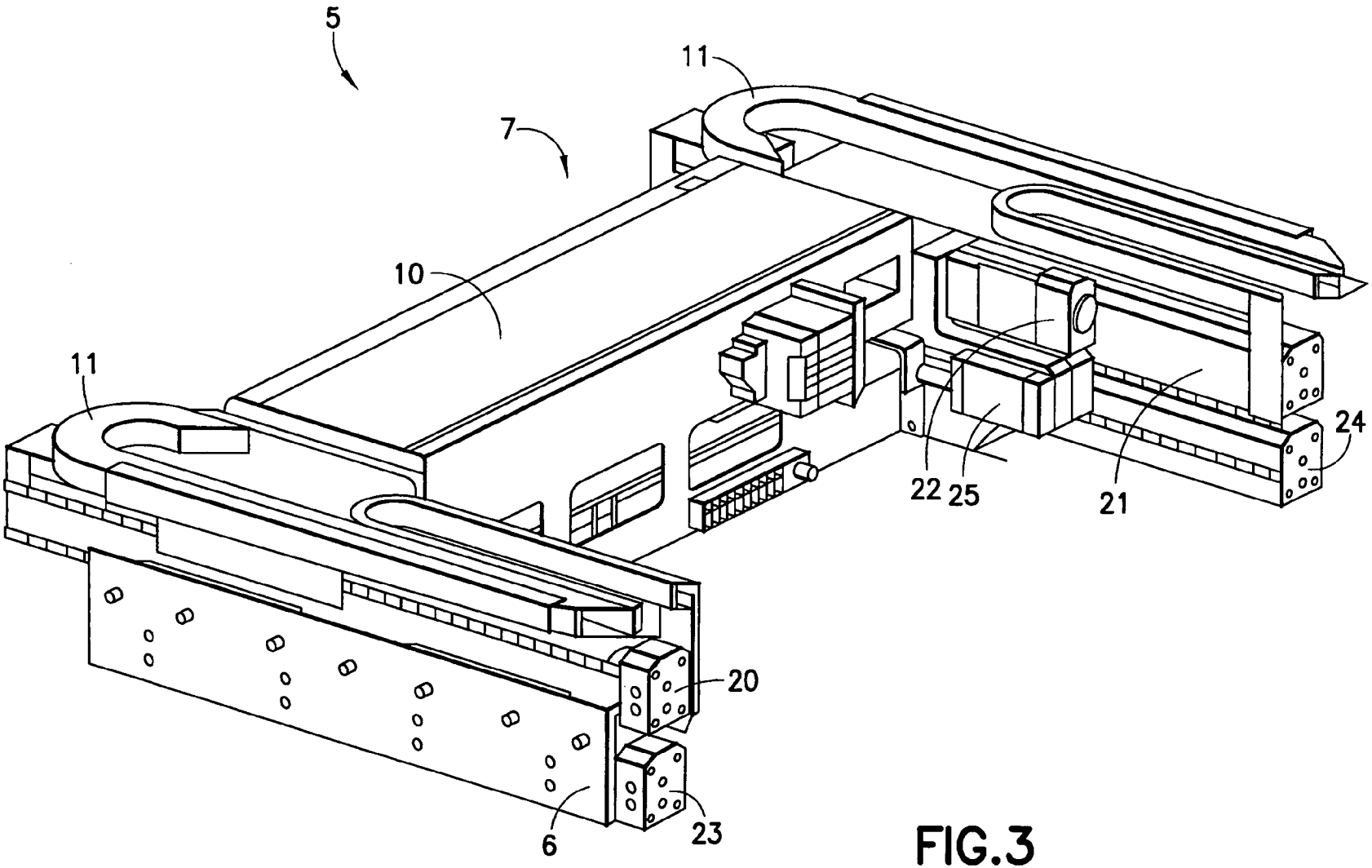
FIG. 3 is a perspective of the positioning unit of the erasing and cleaning apparatus according to the invention from FIG. 2 which has been rotated by 90°.

FIGS. 2 and 3 show the positioning unit 5 with an inserted cassette 4 having identical designations. Additionally, FIG. 3 shows that the carriage 6 is realized by means of rails 20, 21 arranged on both sides of the superstructure 7 to accommodate the cassette 4, along which rails 20, 21 the positioning device 5 can be moved by means of a pneumatic or hydraulic means 22 transversely onto the surface to be cleaned, and two further rails 23, 24 which are fixed rigidly in the printing press likewise on both sides of the superstructure 7 and onto which the movable rails 20, 21 are each placed by means of a carriage 27 (FIG. 6) in order in each case to form a double rail which can be extended telescopically. The rails 20, 21 are displaceable on the fixed rails 23, 24 on the carriages 27 which are connected rigidly to the movable rails 20, 21 and by means of a further pneumatic or hydraulic means 25 which activates the carriages 27, while the positioning device 5 can be moved independently thereof on the movable rails 20, 21.

In a particularly advantageous manner, the positioning unit 5 makes it possible to position the cassette 4 or the cleaning cloth relative to the cylindrical surface to be cleaned, with a plurality of different accessory positions, but at least three different accessory positions; in particular, the positioning unit 5 makes it possible for the feed movement to be adjusted automatically under consideration of the variations in format of the surface to be cleaned.

This comprises the possibility of moving the positioning unit 5 into a respectively defined operating position I, standby position II and out-of-contact position III (FIG. 6), and consideration of the variability in format of a cylindrical surface to be cleaned necessitating an operating position I which can be moved to in a variable manner. Pressure-causing operating positions I can be sensed and adjusted for example, by means of strain gages. During printing operation, it is possible to move the erasing and cleaning apparatus into the standby position II.

According to the invention, an ergonomic removal possibility, that is to say the exchange of this cassette 4, furthermore requires a third defined position of the positioning unit 5 in the printing press, namely the out-of-contact position III, that is to say the position in which the cleaning cloth is to be exchanged. In the out-of-contact position III, it is to be possible to remove a side wall 8 or 9 of the superstructure 7 of the positioning device 5 from the cassette 4, while the cassette 4 remains cantilever-mounted on the other side wall 9 or 8 of the superstructure 7, with the result that the cassette 4 can be removed laterally out of the positioning unit 5 and out of the printing press and a new cassette 4 can be inserted.

Figure 4:
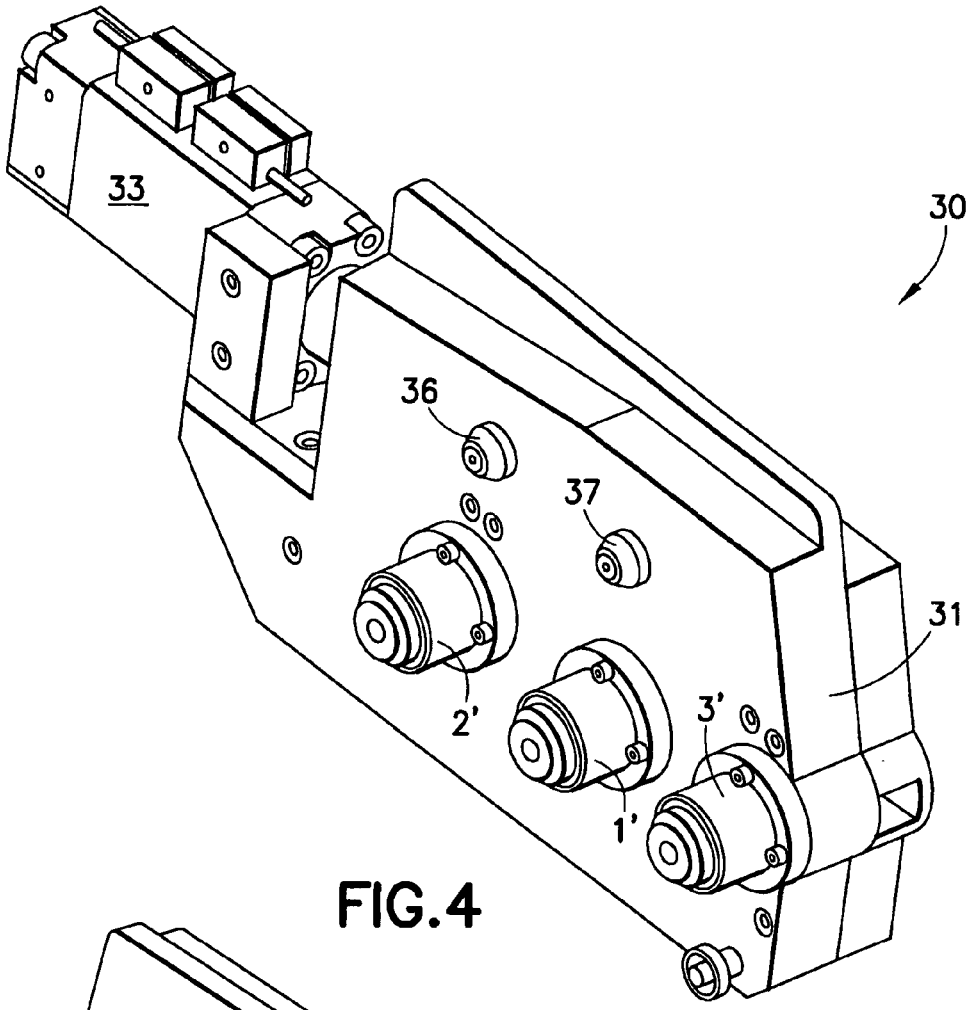
FIG. 4 is a perspective view of a coupling unit according to the invention for the positioning unit for accommodating a cassette.
Figure 5:
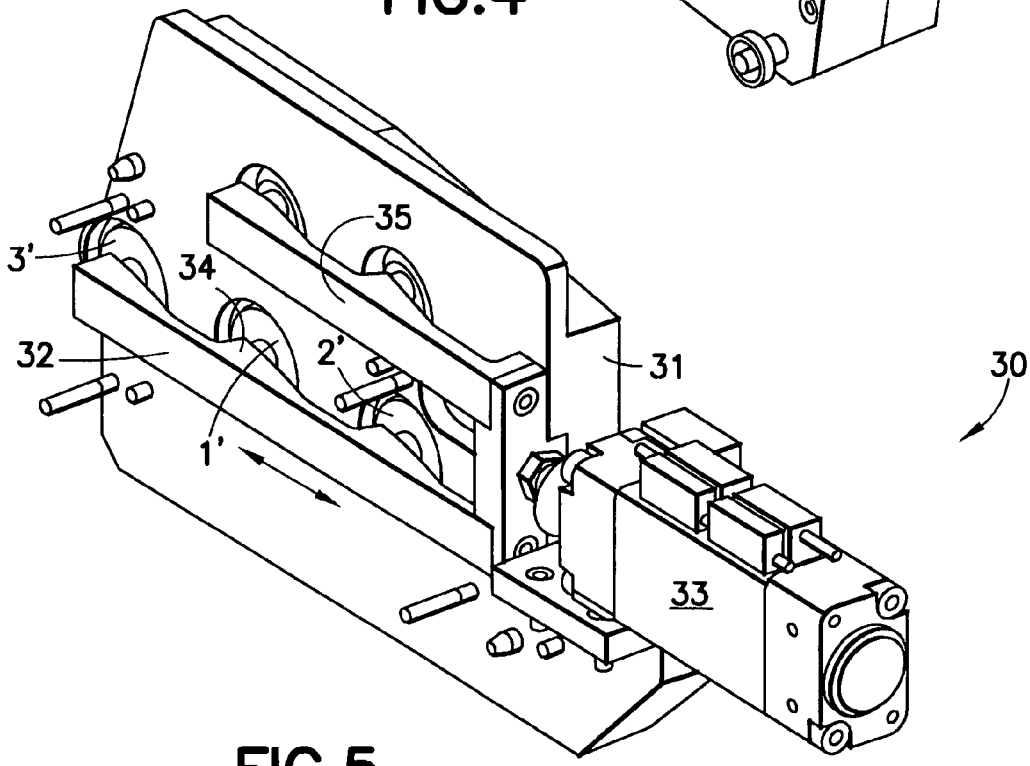
FIG. 5 is a perspective view of the coupling unit of FIG. 4 rotated by 180° and FIG. 6 is a diagrammatic view showing a comparison of the various positioning possibilities of the positioning unit for a cleaning cloth in the printing press.

For this purpose, in accordance with FIGS. 4 and 5, the removable side wall 8 or 9 is provided with a coupling module 30 which is firstly pivotably mounted with the removable side wall 8 or 9 on one of the transversely movable rails 8 or 9, and secondly shaft journals 1', 2', 3' by means of which it is possible to produce a form-fitting and force-transmitting connection to the cleaning cloth transport means 1, 2, 3 of the cassette 4. The shaft journals 1', 2', 3' are mounted in the housing 31 of the coupling module 30 in a spring-loaded manner and are secured against the spring force by means of the cams 34 of a transversely movable cam element 32. The cam element 32 can be acted on by means of a pivotably mounted pneumatic or hydraulic cylinder 33, in such a way that, when it is acted on, the cam element 32 is moved transversely, the cams 34 of the cam element 32 are displaced together with it and therefore terminate the force counter to the spring force acting on the spring-loaded shaft journals 1', 2', 3', with the result that the latter are moved into the interior of the housing 31 of the coupling module 30 by the spring force and are decoupled from the cleaning cloth transport means 1 to 3. If the side wall 8 or 9 is removed by a corresponding movement of the rail 20 or 21, it is possible to expose the cassette 4 for exchange on this side and to remove or exchange it laterally from the positioning unit 5 and therefore laterally from the printing press.

The procedure can be performed in an analogous manner for further cleaning cloth transport means by means of a further cam element 38 and spring-loaded shaft journals 36, 37.

Figure 6:
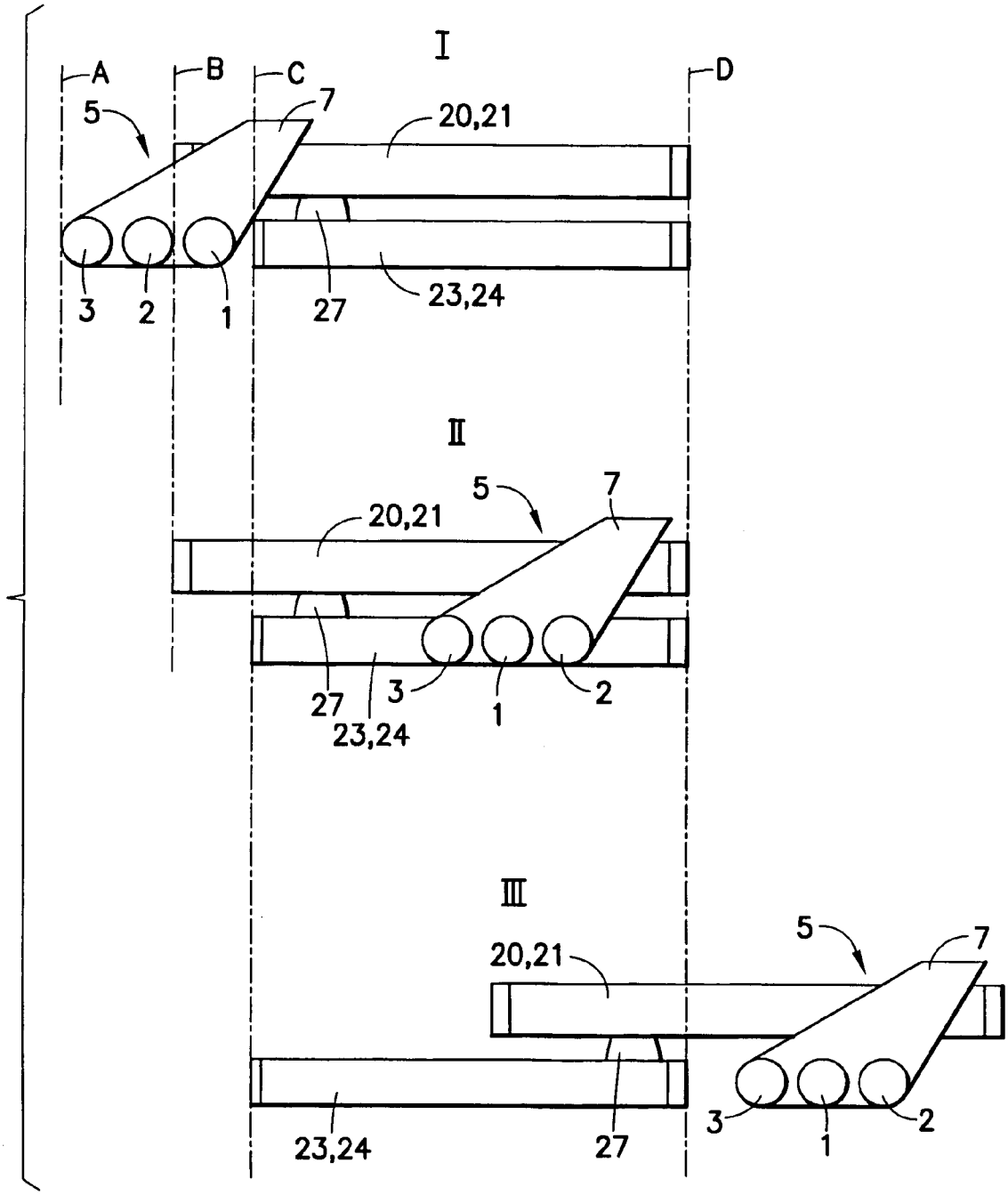

For this purpose, as shown in FIG. 6, it is necessary for both rails 20, 21 to have moved into the out-of-contact position III, that is to say for the positioning unit 5 to be moved into an area of the printing press which is accessible from outside and or be accessible from the side. In this position III, the coupling module 30 is to be actuated as described above, that is to say a side wall 8 or 9 is to be opened, the rail 20 or 21, to which the side wall 8 or 9 which is decoupled from the positioning unit 5 is fastened, is to be retracted again, with the result that the cassette which is cantilever-mounted in the superstructure 7 is accessible and can be removed simply, and a new cassette 4 can be inserted simply again from the side into the positioning unit 5.

FIG. 6 again illustrates the various positions: positions A and B indicate the operating positions I which are to be moved to in a variable manner in consideration of the variability in format of the cylinders to be cleaned. Position A is provided for a small cylinder and Position B is provided for a large cylinder. Position C illustrates the inner edge of the side walls of the printing press and position D illustrates the outer edge of the side walls of the printing press for accommodating the fixed rails 23, 24. It is clear that only the first pneumatic or hydraulic means 22 for the first pair of rails 20, 21 is required to move the positioning unit 5 between the operating position I and the standby position II, the positioning unit 5 always being situated between the inner edge C and outer edge D, it being necessary to move to the out-of-contact position III for lateral exchange of the cleaning cloth and then the second pneumatic or hydraulic means 25 being required to move the positioning unit 5 out transversely beyond the outer edge D of the side walls.

The particular advantage of the present invention is consequently to be seen in the fact that, as a result of the combined lateral guides of the positioning unit 5 in the printing press in the form of their configuration as pairs of double rails 20, 23 and 21, 24 which can be displaced telescopically with respect to one another, and of the coupling module 30 for removing one of the side walls 8 or 9 of the positioning unit 5, it has become possible to exchange a cleaning cloth of an erasing and cleaning apparatus in an ergonomic movement sequence, without it being necessary to stop the printing press or release a paper web.

The erasing and cleaning apparatus is generally suitable for cleaning cylindrical surfaces inside and outside printing presses with the aid of a modular sheet transport unit, but can preferably be used to clean systems which permit rapid image-setting changes in a lithographic process without dismantling the printing form. Printing on demand systems and computer to plate systems may be mentioned here by way of example.

The invention claimed is:

1. An erasing and cleaning apparatus for cylindrical surfaces including printing forms and blanket cylinders of a printing press, comprising:

a cassette including means for transporting a cleaning cloth, said means for transporting being packageable with the cleaning cloth in said cassette;

a positioning unit having a superstructure for accommodating said cassette and including sidewalls connected by a crossmember, said cassette being exchangeabley inserted between said sidewalls of said positioning unit, said positioning unit being drivable for driving said means for transporting;

a lateral guide arrangeable in the printing press comprising a carriage and means for moving the positioning unit between a first position, in the which the means for transporting is moved onto the cylindrical surface to be cleaned, and an out-of-contact position, at which said cassette is laterally removable from said positioning unit, said carriage comprising two telescopically displaceable pairs of double rails connectable to the printing press, each of said double rails comprising a fixed rail and a moveable rail, said carriage being connected to said movable rails; and at least one coupling module for selectively coupling and decoupling a removable one of said sidewalls of said positioning unit and said cassette, wherein said coupling module is pivotally mounted with said removable one of said side walls on one of said movable rails, said coupling module comprising a housing, shaft journals for producing a form-fitting and force transmitting connection, said shaft journals being mounted in said housing by a spring loaded mounting, and a transversely movable cam element comprising cams for securing said shaft journals against a spring force of the spring loaded mounting.

2. The erasing and cleaning apparatus of claim 1, wherein each of said pairs of double rails includes means for moving said positioning unit relative to said movable rails and means for moving said moveable rails relative to said fixed rails, each of said means for moving comprising one of hydraulic and pneumatic cylinders.

3. The erasing and cleaning apparatus of claim 1, further comprising one of a hydraulic and pneumatic cylinder actuatable for moving said movable cam for terminating the force counter to the spring force acting on said shaft journals, thereby permitting said shaft journals to decouple from said means for transporting and move into said housing by the spring force, said removable one of said sidewalls being removable and said movable rail connected to said removable one of said side walls being movable when said shaft journals are decoupled for exposing said cassette and allowing lateral removal thereof from said positioning unit.

4. The erasing and cleaning apparatus of claim 2, further comprising additional means for transporting a cleaning cloth, further spring-loaded shaft journals and a further cam element for securing said further shaft journals against a spring force of the spring loaded mounting.

* * * * *